US006798419B1

(12) United States Patent
Klein

(10) Patent No.: US 6,798,419 B1
(45) **Date of Patent: *Sep. 28, 2004**

(54) METHOD FOR DISPLAYING DATA ON A VIDEO DISPLAY

(75) Inventor: Dean A. Klein, Eagle, ID (US)

(73) Assignee: Micron Technology, Inc., Boise, ID (US)

( * ) Notice: Subject to any disclaimer, the term of this patent is extended or adjusted under 35 U.S.C. 154(b) by 536 days.

This patent is subject to a terminal disclaimer.

(21) Appl. No.: 09/684,701

(22) Filed: Oct. 6, 2000

Related U.S. Application Data

(63) Continuation of application No. 08/712,893, filed on Sep. 12, 1996, now Pat. No. 6,160,561.

(51) Int. Cl.[7] ..... G09G 5/00

(52) U.S. Cl. ..... 345/536; 345/519; 345/520; 345/698; 345/552

(58) Field of Search ..... 345/132, 1–3, 345/530–532, 545, 547, 551, 552, 564, 566–574, 535, 536, 698, 699, 519, 520

(56) References Cited

U.S. PATENT DOCUMENTS

| | | | | |
|---|---|---|---|---|
| 4,642,563 A | | 2/1987 | McEachern et al. | 324/111 |
| 4,696,004 A | | 9/1987 | Nakajima et al. | 371/25 |
| 4,790,025 A | | 12/1988 | Inoue et al. | 382/41 |
| 5,276,458 A | | 1/1994 | Sawdon | 345/132 |
| 5,280,589 A | | 1/1994 | Nakamura | 395/325 |
| 5,387,923 A | | 2/1995 | Mattison et al. | 345/103 |
| 5,402,148 A | | 3/1995 | Post et al. | 345/132 |
| 5,488,385 A | | 1/1996 | Sirghal et al. | 345/3 |
| 5,696,531 A | | 12/1997 | Suzuki et al. | 345/132 |
| 5,745,104 A | * | 4/1998 | Minoura | 345/150 |
| 5,751,259 A | | 5/1998 | Iwamoto | 345/8 |
| 5,799,202 A | | 8/1998 | Rongione | 712/1 |
| 5,844,545 A | | 12/1998 | Suzuki et al. | 345/156 |
| 5,860,016 A | | 1/1999 | Nookala et al. | 713/324 |

FOREIGN PATENT DOCUMENTS

| | | | |
|---|---|---|---|
| JP | 55092957 | * | 7/1980 |
| JP | 35 5092957 | | 7/1980 |

OTHER PUBLICATIONS

Intel Corporation, *Accelerated Graphics Port Interface Specification*, Revision 2.0, pp. 1–259 (May 4, 1998).

Intel Corporation, *Intel Establishes Accelerated Graphics Port Implementors Forum to Promote High–Performance 3D Graphics for PCS*, printed from www.intel.com (May 8, 1996).

* cited by examiner

*Primary Examiner*—Lun-Yi Lao
(74) *Attorney, Agent, or Firm*—Trop, Pruner & Hu, P.C.

(57) ABSTRACT

In a method and apparatus for displaying data on a video display that is controlled by a video controller, the video controller is coupled to a high-speed memory and a low-speed memory. The memories have separate data paths. A video address corresponding to a location on the video display is received. If a specified address bit is in a first state, then data is displayed from the high-speed memory. If the specified address bit is in a second state, then data is displayed from the low-speed memory. The specified address bit may be a high order address bit that is not utilized by a conventional VGA controller to transmit address information.

18 Claims, 3 Drawing Sheets

METHOD FOR DISPLAYING DATA ON A VIDEO DISPLAY

Figure 1:
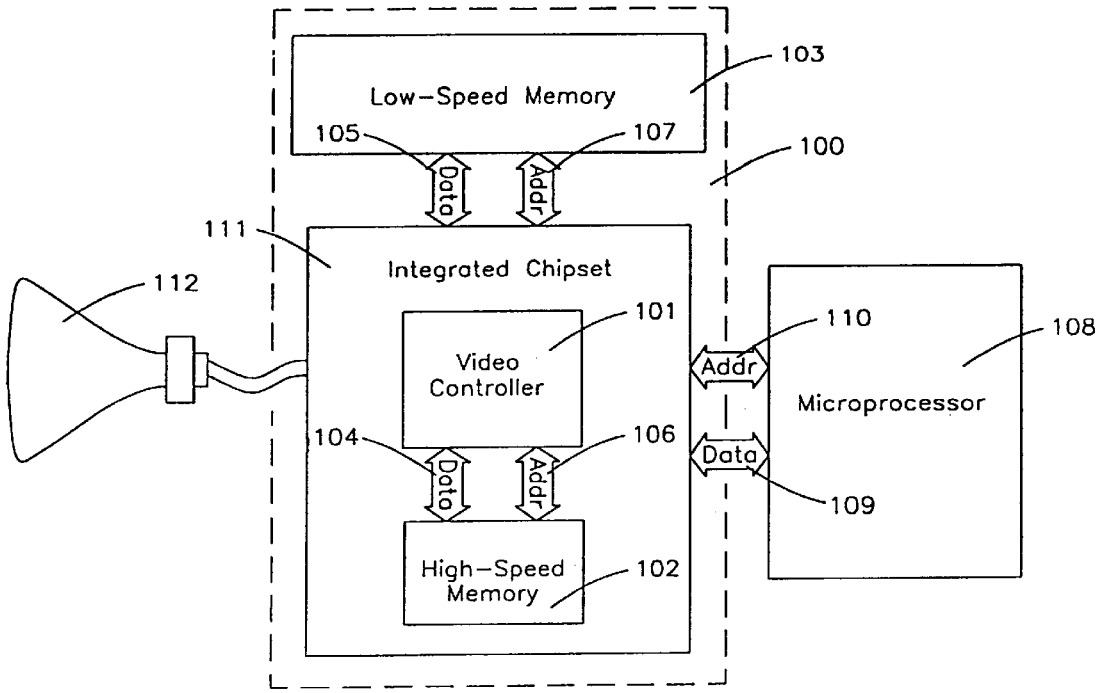

This is a continuation of U.S. patent application Ser. No. 08/712,893, filed Sep. 12, 1996, now U.S. Pat. No. 6,160, 561.

1. BACKGROUND OF THE INVENTION

The invention relates to a method for displaying data on a video display. More specifically, the invention relates to a method for displaying data on a video display controlled by a video controller subsystem having a high-speed memory and a low speed memory.

Many modern personal computers contain a relatively small number of electronic components. The motherboard components typically include a microprocessor, system memory, video memory, a video controller, and a chipset.

Video memory is a block of RAM in the video subsystem in which displayable data is stored. The video memory typically lies within the address space of the microprocessor. Thus, a program executing within the microprocessor can read from and write to video memory in the same way that is accesses system memory.

The video controller is a device that continually and repeatedly refreshes a video display by generating horizontal and vertical timing signals. The video controller also increments a video memory address counter at a rate that is synchronized with the timing signals. The video controller then reads data from the video memory using the address counter and decodes the data. Next, the video controller sends the decoded color and brightness signals along with the timing signals to the video display. This reading, decoding and sending cycle repeats between 60 and 78 times per second on conventional personal computers.

As a result of the synchronization discussed above, each bit or group of bits in the video memory specifies the color and brightness of a particular pixel on the video display. Thus, a bit can be said to correspond to a particular location on the video display.

As is well known by those skilled in the art, the chipset performs the function of interfacing the microprocessor to system memory and to system buses. In an effort to further reduce the component count and system cost, some modem chipset designs integrate the video controller and the chipset on a single device. This device will be referred to as an integrated chipset. The integrated chipset is made possible by the advancement of packaging technologies such as the high pin-count ball grid array (BGA) packages. The BGA packages allow a single device to incorporate all the required interfaces between the system memory and the microprocessor.

The inclusion of the video controller into the chipset may also eliminate the need for a separate video memory. However, if system memory is used to store video data, a reduction in performance occurs. This reduction in performance is due to the fact that both the video controller and microprocessor must share access to system memory. A personal computer with a state-of-the-art memory bus has a theoretical peak transfer rate of 264 MB/sec (Megabytes/sec). However, a 72 Hz video display system with a resolution of 1280×1024 pixels, each pixel being one of a possible 64 thousand colors, requires a video data bandwidth of approximately 260 MB/sec. Even a more moderate 72 Hz video display system with a resolution of 800×600 pixels, each pixel being one of a possible 64 thousand colors, requires a video data bandwidth of approximately 100 MB/sec. Thus, it is evident that the video data bandwidth is a significant portion of the total system memory bandwidth of a personal computer. As a result, the microprocessor must spend significant portions of its time waiting for access to system memory.

In addition, to the high pin-count packages, recent advances in semiconductor processing have reduced semiconductor geometries. Thus, space exists on the integrated chipset die for additional functionality.

2. SUMMARY OF THE INVENTION

The invention relates to a method and apparatus for displaying data on a video display that is controlled by a video controller. The video controller is coupled to a high-speed memory and a low-speed memory. The memories have separate data paths. The method consists of first receiving a video address corresponding to a location on the video display. Next, if a specified address bit is in a first state, then data is displayed from the high-speed memory. If the specified address bit is in a second state, then data is displayed from the low-speed memory. The specified address bit may be a high order address bit that is not utilized by a conventional VGA controller to transmit address information.

3. BRIEF DESCRIPTION OF THE DRAWINGS

Figure 2:
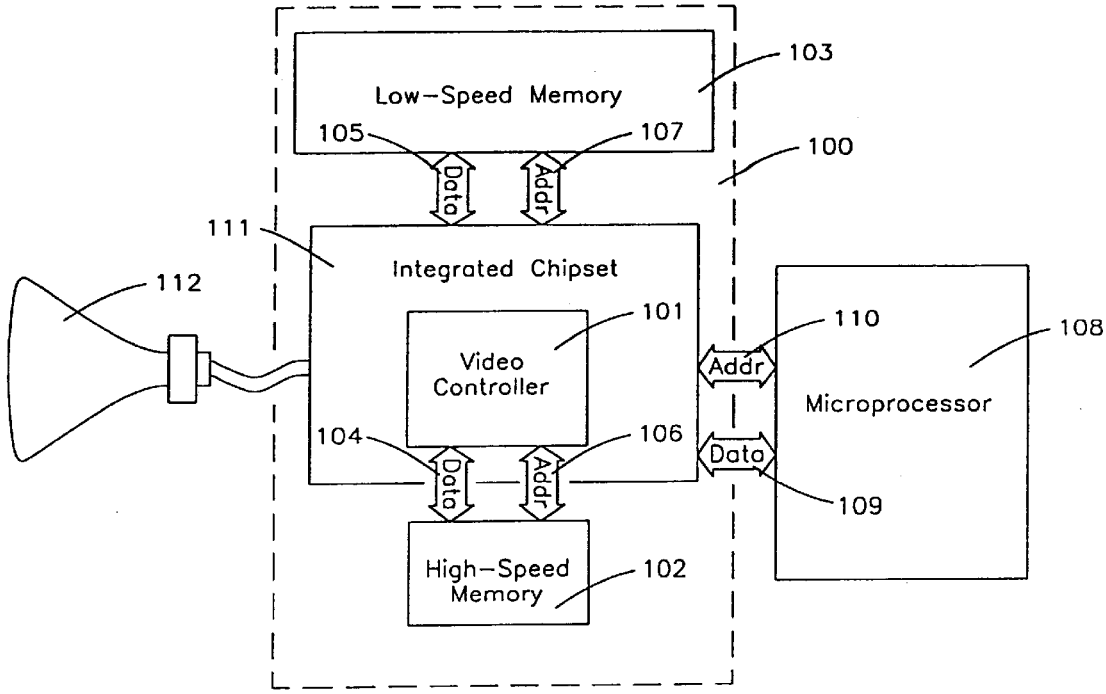
Figure 3:
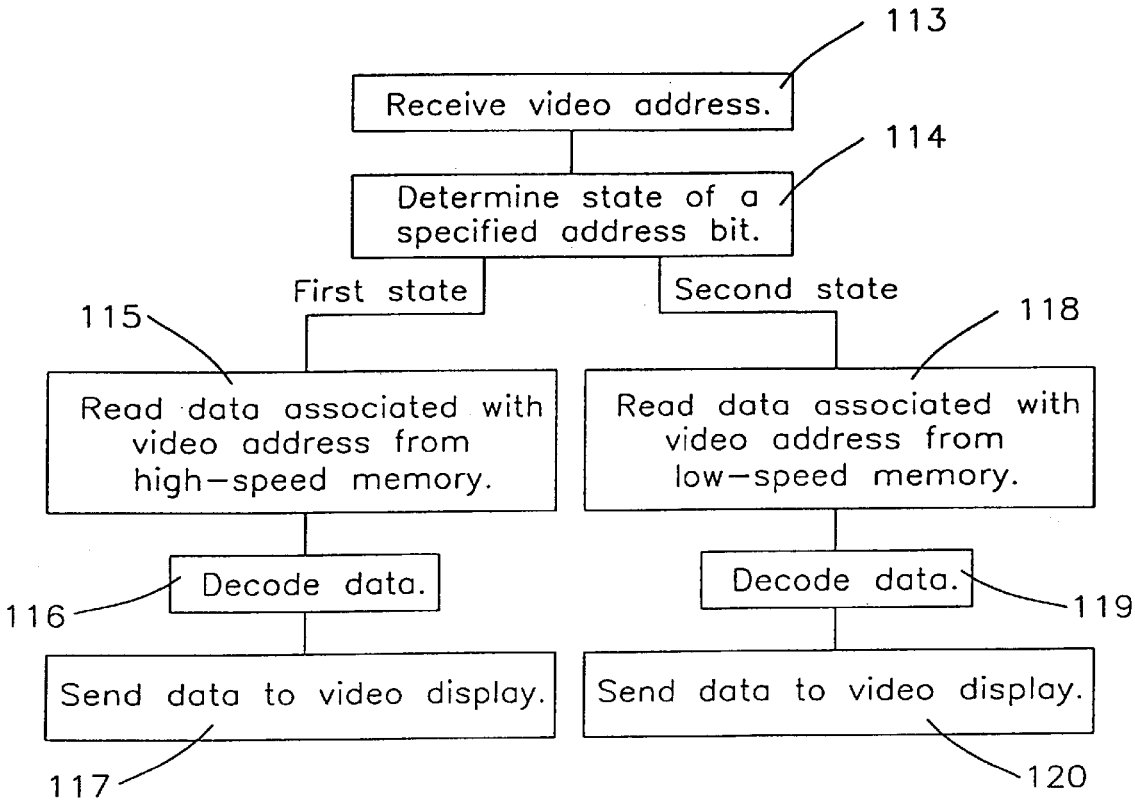

FIG. 1 is a simplified view of an embodiment of the present invention. FIG. 2 is a simplified view of an alternative embodiment of the present invention. FIG. 3 is a flow-chart overview of a method usable with the apparatus of FIG. 1 and/or FIG. 2.

4. DESCRIPTION OF ILLUSTRATIVE EMBODIMENTS

In the following detailed description numerous specific details are set forth in order to provide a thorough understanding of the present invention. However, it will be understood by those skilled in the art that the present invention may be practiced without these specific details. In other instances, well known methods, procedures, components, and circuits have not been described in detail so as not to obscure the present invention.

Some portions of the detailed descriptions which follow are presented in terms of algorithms and symbolic representations of operations on data bits within a computer memory. These algorithmic descriptions and representations are the means used by those skilled in the art to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, or otherwise manipulated. It has proven convenient at times, principally for reasons of common usage, to refer to these signals as bits, values, elements, symbols, characters, terms, numbers, or the like. It should be born in mind, however, that all of these and similar terms are to be associated with the appropriate physical quantities and are merely convenient labels applied to these quantities. Unless specifically stated otherwise as apparent from the following discussions, it is appreciated that terms such as "processing," "computing," "calculating," "determining" or the like, refer to the action and processes of a computer system or similar electronic computing device, that manipulates and transforms data represented as physical (electronic) quantities within the computer system's registers and/or memories into other data similarly represented as physical quantities within the computer system memories, registers and/or other such information storage, transmission, or display devices.

4.1 Video Controller Subsystem

As shown in FIG. 1, the video controller subsystem 100 of the present invention consists of a video controller 101, and two memories 102 and 103. The first memory, referred to as high-speed memory 102, is capable of operating at a higher speed than the second memory. The second memory will be referred to as low-speed memory 103. The video controller subsystem 100 is connected to a microprocessor 108 by a datapath 109 and an address bus 110. In addition, the video controller subsystem 100 is conventionally connected to a video display 112. The video display 112 can be any conventional video display such as a cathode ray tube or a flat panel display.

The video controller 101 of the video controller subsystem 100 is connected to the memories 102 and 103 by two different datapaths 104 and 105. In addition, the video controller may be connected to the memories by two different address buses 106 and As shown in FIG. 1, the high-speed memory 102 may be included on the die of the integrated chipset 111 while the low-speed memory 103 may be conventional system memory. Alternatively, as shown in FIG. 2, the high-speed memory 102 may be distinct from the integrated chipset 111.

4.2 Method of Operation

As shown in block 113 of FIG. 3, the integrated chipset 111 first receives a video address from the microprocessor 108. This video address corresponds to a particular location on the video display at which data is to be displayed. This video address is communicated from the microprocessor 108 to the integrated chipset 111 by address bus 110.

Address bus 110 contains a plurality of conventional address lines. These address lines communicate address bits to the video controller 101. These address bits can be subdivided into high order address bits and low order address bits. A low order address bit is an address bit that is utilized to communicate address information in a conventional Video Graphics Array (VGA) video controller. As is known in the art, the VGA video controller has become the de facto video controller standard in part because it was included in the original IBM PS/2 Models 50, 60, and 80. A high-order address bit is an address bit that is not a low-order address bit.

Next, as shown in block 114 of FIG. 3, circuitry in the integrated chipset 111 determines the state of a specified address bit in address bus 110. As shown in blocks 115–117 of FIG. 3, if the state of the specified address bit is in a first state, then data stored within the high-speed memory 102 is repeatedly read, decoded, and sent to the video display 112. Thus, if the state of the specified address bit is in a first state, then data is displayed from the high-speed memory 102 on the video display 112. Similarly, as shown in blocks 118–120 of FIG. 3, if the state of the specified address bit is in a second state, then data stored within the low-speed memory 103 is repeatedly read, decoded, and sent to the video display 112.

The specified address bit can be selected so that, in higher resolution modes, the high-speed memory can store data for a portion of the display area. For example, the data corresponding to an upper portion of a video display 112 may be stored in the high-speed memory 102 while the data corresponding to a lower portion of a video display 112 may be stored in the low-speed memory 103. Alternatively, the high-speed memory 102 may store the data corresponding to every Nth line on the video display 112 where N is any positive integer. In another embodiment, where high resolution text is being displayed, the low-speed memory may store ASCII character codes, while the high-speed memory stores one or more fonts.

4.3 Remarks

Use of the invention permits an economical video subsystem that contains high-speed VGA compatible video memory. Thus, VGA compatible software can be efficiently executed. Because the high-speed VGA compatible memory data bus is distinct from the system memory data bus, no reduction in system performance occurs when executing VGA compatible software. For economical reasons and/or because the available die space is limited, only a limited amount, such as 256K, of high-speed memory may be included on the integrated chipset.

Even though the amount of high-speed memory is limited, the invention supports high resolution video modes that require large amounts of memory. When high resolution video modes are utilized, the video subsystem can utilize low-speed system memory to satisfy the additional storage requirements. Because only a portion of the display is stored in system memory, the system performance reduction is reduced.

4.4 Program Storage Device

Any of the foregoing variations may be implemented by programming a suitable video controller having appropriate hardware. The programming may be accomplished through the use of a program storage device readable by the video controller and encoding a program of instructions executable by the computer for performing the operations described above. The program storage device may take the form of, e.g., one or more floppy disks, a hard disk, a CD ROM or other optical, magnetic or combination optical/magnetic disk, a magnetic tape, a read-only memory chip (ROM), and other forms of the kind well-known in the art or subsequently developed. The program of instructions may be "object code," i.e., in binary form that is executable more or less directly by the video controller, in "source code" that requires compilation or interpretation before execution, or in some intermediate form such as partially compiled code. The precise forms of the program storage device and of the encoding of instructions are immaterial here except as may be noted otherwise above.

It will be appreciated by those of ordinary skill having the benefit of this disclosure that the illustrative embodiments described above are capable of numerous variations without departing from the scope and spirit of the invention. Accordingly, the exclusive rights sought to be patented are as described in the claims below.

What is claimed is:

1. A method for displaying an image on a video display comprising:

using a video controller to receive a video address corresponding to characteristics of a portion of an image to be displayed on a video display, said video address including a plurality of video address bits;

using the video controller to read video data of a first type at a first rate over a first datapath from a high-speed memory if a specified video address bit is in a first state to enable creation of a portion of the image for display on the video display; and using the video controller to read video data of a second type at a second rate over a second datapath from a low-speed memory if the specified video address bit is in a second state to enable creation of the portion of the image for display on the video display.

2. The method of claim 1 wherein the specified bit comprises a high order video address bit for a VGA video mode.

3. The method of claim 1 wherein the act of using the video controller to read data of a second type includes using a high-speed memory having a capacity less than the total amount of data to be used to create an image on the video display.

4. The method of claim 1, further comprising combining the data of the first type with the data of the second type to create a portion of an image.

5. The method of claim 4 wherein the portion of an image is an enhanced quality graphical representation resulting from characteristics decoded from both the data of the first type and the data of the second type.

6. The method of claim 4 wherein the portion of an image is a stylized alphanumeric character formed from a combined character code and font.

7. The method of claim 1, further comprising transferring the data of a second type to the video controller over a datapath separate from an address bus used to specify the data to be transferred to the video controller.

8. The method of claim 1, wherein using the video controller to read video data from the low-speed memory comprises reading video data from system memory.

9. The method of claim 1, wherein using the video controller to read video data from the low-speed memory comprises reading video data from system memory of a computer.

10. A method for displaying an image on a video display comprising:

receiving, by a video controller, a video address corresponding to characteristics of a portion of an image to be displayed on a video display, said video address including a plurality of video address bits;

reading, by a video controller, data of a first type at a first rate over a first datapath from a high-speed memory coupled to the video controller if a specified video address bit is in a first state and preparing for display a portion of an image decoded from the first type data; and reading, by the video controller, data of a second type at a second rate over a second datapath from a low-speed memory coupled to the video controller if the specified video address bit is in a second state and preparing for display the portion of an image decoded from the second type of data.

11. The method of claim 10, wherein the specified bit comprises a high order video address bit for a VGA video mode.

12. The method of claim 10, wherein the act of reading from the high-speed memory includes reading from a high-speed memory having a capacity less than the total amount of data to be used to create an image on the video display.

13. The method of claim 10 wherein the data of the first type is combined with the data of the second type to create a portion of an image.

14. The method of claim 13 wherein the portion of an image is an enhanced quality graphical representation resulting from characteristics decoded from both the data of the first type and the data of the second type.

15. The method of claim 13 wherein the portion of an image is a stylized alphanumeric character formed from a combined character code and font.

16. The method of claim 10, further comprising transferring the data of a second type to the video controller over a datapath separate from an address bus used to specify the data to be transferred to the video controller.

17. The method of claim 10, wherein reading data from the low-speed memory comprises reading data from system memory.

18. The method of claim 10, wherein reading data from the low-speed memory comprises reading data from system memory of a computer.

* * * * *